United States Patent [19]

Kägi

[11] Patent Number: 4,627,147

[45] Date of Patent: Dec. 9, 1986

[54] METHOD OF CONSTRUCTING A REFRACTORY PLATE ASSEMBLY FOR USE IN A SLIDING CLOSURE UNIT

[75] Inventor: Otto Kägi, Cham, Switzerland

[73] Assignee: Stopinc Aktiengesellschaft, Baar, Switzerland

[21] Appl. No.: 721,068

[22] Filed: Apr. 8, 1985

[30] Foreign Application Priority Data

Apr. 24, 1984 [CH] Switzerland ..... 2002/84

[51] Int. Cl.[4] ..... B21D 39/00; B23P 11/00

[52] U.S. Cl. ..... 29/515; 29/283.5; 222/600; 266/236; 266/271; 266/287

[58] Field of Search ..... 29/516, 517, 515, 283.5; 222/600; 266/236, 271, 287

[56] References Cited

U.S. PATENT DOCUMENTS

| | | | |
|---|---|---|---|
| 3,779,424 | 12/1973 | Shapland, Jr. | 222/600 X |
| 3,801,087 | 4/1974 | Akaike et al. | 29/517 X |
| 4,376,501 | 3/1983 | Hafner et al. | 222/600 |
| 4,508,324 | 4/1985 | Luhrsen et al. | 222/600 X |
| 4,554,035 | 11/1985 | Stein et al. | 222/600 X |

FOREIGN PATENT DOCUMENTS

| | | |
|---|---|---|
| 3108748 | 12/1981 | Fed. Rep. of Germany . |
| 3223181 | 12/1983 | Fed. Rep. of Germany . |

*Primary Examiner*—Charlie T. Moon

*Attorney, Agent, or Firm*—Wenderoth, Lind & Ponack

[57] ABSTRACT

A refractory plate assembly for use in a sliding closure unit includes a plate-shaped refractory member having therethrough at least one discharge opening and a metal jacket surrounding the peripheral edge of the refractory member. Such assembly is constructed by providing the refractory member with at least one indentation extending inwardly from the peripheral edge of the refractory member. A metal ring is positioned to surround the peripheral edge of the refractory member such that a portion of the metal ring extends across the indentation. This portion of the metal ring is pressed into the indentation until an innermost external surface of such portion is spaced a predetermined distance from the external surface of the metal ring at a position at the peripheral edge of the refractory member opposite the indentation. This pressing involves permanently increasing the length of the metal ring by stressing the metal ring beyond the elastic limit thereof and thereby permanently deforming the metal ring into tight contact with the peripheral edge of the refractory member.

14 Claims, 11 Drawing Figures

METHOD OF CONSTRUCTING A REFRACTORY PLATE ASSEMBLY FOR USE IN A SLIDING CLOSURE UNIT

BACKGROUND OF THE INVENTION

The present invention relates to a method of manufacturing or constructing a ceramic refractory plate assembly for use in a sliding closure unit, the assembly being of the type including a plate-shaped refractory member having therethrough at least one discharge opening and a metal jacket surrounding the circumferential or peripheral edge of the refractory member. Assemblies of this type are widely employed in sliding closure units for regulating the discharge of molten materials, particularly molten steel.

DE-OS No. 31 08 748 discloses a refractory plate assembly of this general type wherein the refractory plate or member is connected to the sheet metal jacket or ring (in this instance the jacket includes a bottom surface) by a layer of refractory mortar. However, construction of an assembly employing mortar is an expensive operation. In addition, there exists the danger that the layer of mortar will not always be able to withstand the stresses which occur when the assembly is clamped in a metal support frame of a sliding closure unit and during sliding movements thereof.

It also is known that the metal jacket can be applied by shrinking a heated ring onto the peripheral edge of the refractory plate, or by applying the jacket in the form of a multilayer wound strip directly onto the circumference or periphery of the refractory plate. In both of these methods however, considerable variations of the dimensions of the refractory plates, arising from the manufacture thereof, are directly transferred to the outer dimensions of the metal jacket, and thus to the entire refractory plate assembly. In other words, exterior dimensional variations inevitably occur in the manufacture of the refractory plate-shaped members, and these dimensional variations are incorporated into the metal jackets applied by these operations. Therefore, it is necessary to provide either extensive further processing of the refractory plates before the jackets are fitted thereon and/or to provide subsequent machining of the exterior surfaces of the jackets, to ensure that the assemblies can be properly inserted and fit into, in an interchangeable manner, the respective support frames of the sliding closure units.

DE-OS No. 32 23 181 discloses a sheet metal ring in the form of a tension band fitted to a refractory plate by means of a tension jack. The tension band and tension jack form a device for fastening the refractory plate in its support frame, whereby the tension jack also must be worked or machined for the above discussed reasons. This publication discloses another arrangement wherein a metal ring is loosely positioned around a refractory plate and functions as part of the fastening device by being pressed in and deformed into lateral recesses in the plate by screws mounted on the support frame after the plate has been positioned therein. This type of arrangement wherein the plate is fastened in the support frame however is complicated and does not satisfactorily meet the desirable features of providing a properly seated and removable connection.

SUMMARY OF THE INVENTION

With the above discussion in mind, it is an object of the present invention to provide an economical method of manufacturing or constructing a refractory plate assembly of the type described above, whereby further working or machining of the periphery of the refractory plate and/or the exterior of the metal jacket is avoided.

It is a further object of the present invention to provide such a method without the need for use of refractory mortar.

It is a yet further object of the present invention to provide such a method whereby it is possible to produce refractory plate assemblies which may be mounted in respective support frames in a precise and readily removable manner.

It is an even further object of the present invention to provide such a method whereby it is possible to produce such assemblies which easily may be mounted in the respective support frames thereof in a manner to ensure a good seat between abutting surfaces of two assemblies in the sliding closure unit.

The above and other objects of the present invention are achieved in accordance with the present invention by providing the refractory member with at least one indentation extending inwardly from the peripheral edge of the refractory member, positioning a metal jacket or ring to surround the peripheral edge of the refractory member such that a portion of the metal ring extends across the indentation, pressing such portion of the metal ring into the indentation until an innermost external surface of such portion is spaced a predetermined distance from the external surface of the metal ring at a position at the peripheral edge of the refractory member opposite the indentation, such pressing comprising permanently increasing the length of the metal ring by stressing the metal ring beyond the elastic limit thereof and thereby permanently deforming the metal ring into tight and intimate contact with the peripheral edge of the refractory member.

By this novel method, it is possible to precisely form sections or areas of the assembly at edges thereof, such areas having a predetermined dimensional relationship with respect to each other, independent of the particular exterior dimensions, which are subject to substantial variations during manufacture, of the refractory plates. In other words, the metal ring is permanently deformed into contact with the peripheral edge of the refractory member, and this deformation is achieved by pressing operations carried out in a manner to achieve a precise dimensional relationship between spaced locations of the assembly, independent of the actual dimensions of the refractory member. These precisely located edge sections or areas then are employed to mount the assembly in the respective support frame by means of centering and connecting devices thereon. This additionally results in a particularly advantageous transfer of displacement forces between the support frame and the refractory plate assembly at such sections or areas formed as indentations into the edges of the assembly. The permanent elongation and plastic deformation of the sheet metal ring produces a constant tensile stress in the circumferential direction thereof which operates to hold or enclose the refractory member during later use. It surprisingly has been found that this tensile stress remains, given suitably formed indentations of different shapes, and does not result in elastic "spring back" of the pressed-in sections of the metal ring, since such ring sections become anchored into the indentations during deformation of the metal ring.

BRIEF DESCRIPTION OF THE DRAWINGS

Other objects, features and advantages of the present invention will be apparent from the following detailed description of preferred embodiments, with reference to the accompanying drawings, wherein.

DETAILED DESCRIPTION OF THE INVENTION

Figure 1:
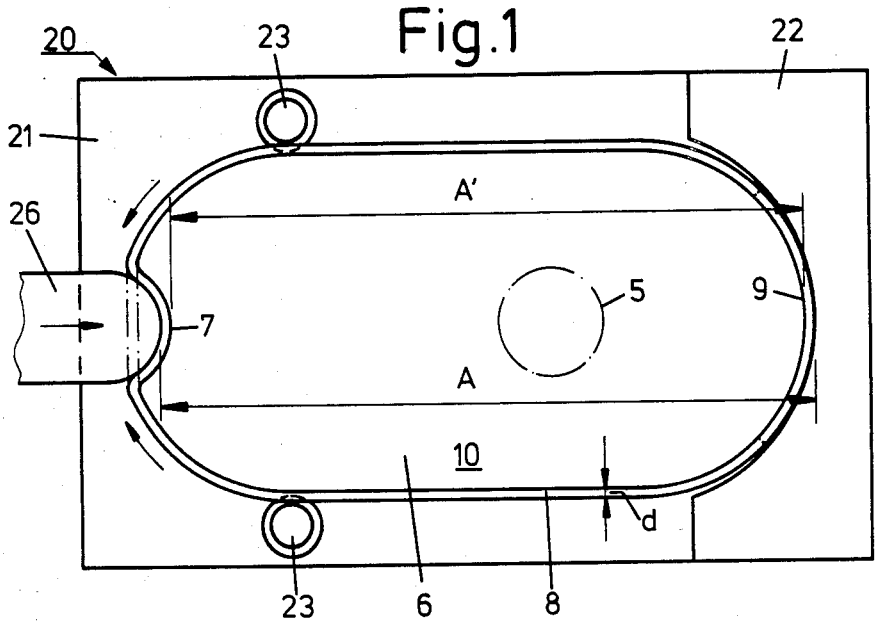
FIG. 1 is a schematic top view illustrating a refractory plate assembly constructed in accordance with one embodiment of the present invention.
Figure 2:
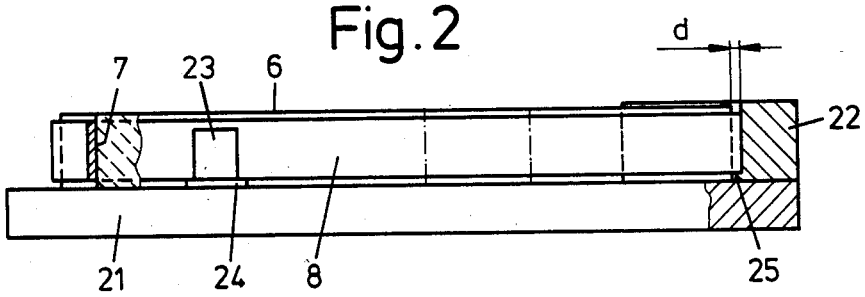
FIG. 2 is a side view, partially in section, of the arrangement of FIG. 1, but with the stamping device thereof not shown.

FIGS. 1 and 2 illustrate the method of the present invention for constructing a refractory plate assembly 10 of an oblong shape for use in a linear sliding closure unit. Assembly 10 includes an elongated plate-shaped refractory member 6 and a metal jacket 8 surrounding the peripheral edge of refractory member 6. A discharge opening 5 required for subsequent use of the assembly in a sliding closure unit is indicated by dashed lines. Opening 5 can be produced before, during or after the construction method of the present invention.

Refractory member 6 is provided with an indentation 7 extending inwardly from the peripheral edge of the refractory member. Preferably indentation 7 is in the form of an arc of a circle. Also preferably, indentation 7 is located at an end area of member 6 most removed from discharge opening 5, which as illustrated is located closer to end 9 of member 6 opposite indentation 7.

A metal ring to form jacket 8 is positioned to surround the peripheral edge of refractory member 6, and member 6 and the metal ring are positioned on a stamping device 20. As illustrated by the dashed lines in FIG. 1, a portion of the metal ring extends across the mouth of indentation 7. The metal ring is formed to have a thickness d and is preformed to have a shape substantially corresponding to the rough contour of the periphery of member 6. As shown in FIG. 2, the width of the metal ring is somewhat less than the thickness of member 6. The metal ring is formed of a suitable metal material, for example a steel suitable for cold forming, i.e. of deep-drawing quality.

Stamping device 20 includes a base plate 21, a solid stop 22 for end 9, a plurality of bolt-shaped lateral stops 23 for laterally guiding the assembly 10, and a stamping tool 26 movable in the direction of the arrow in FIG. 1. The height of stamping tool 26 is dimensioned to be approximately equal to or somewhat larger than the width of the metal ring. Supports 24, 25 are provided in the areas of stops 23 and 22 to ensure that the metal ring initially is positioned at a suitable height in relation to refractory member 6.

To construct the assembly 10, the refractory plate 6 and the surrounding metal ring are positioned on stamping device 20 with stamping tool 26 in a retracted position. Stamping tool 26 is moved under power in the direction of the arrow and presses against that portion of the metal ring in the area of indentation 7. This causes the end 9 and the surrounding portion of the metal ring to be pressed against stop 22. Further pressing causes that portion of the metal ring at the indentation 7 to be pressed into the indentation. Specifically, this pressing causes a plastic deformation both by bending of the metal ring in the area of stamping tool 26 and by elongation of the metal ring to increase its length. Thus, the total length of the metal ring after being pressed into the indentation 7 is substantially longer than the initial total length of the metal ring. The metal ring is stressed beyond the elastic limit or yield point, i.e. beyond the elastic range thereof and thus is permanently elongated and deformed into intimate and tight contact with the peripheral edge of refractory member 6. Such tight contact results in a non-positive attachment of the metal ring and is due to the strong tensile stress produced therein during the pressing operation.

The metal ring initially may be loosely positioned around refractory member 6 as a preformed ring, as discussed above, whereby there initially will be a circumferential or lateral play between the interior of the ring and the peripheral edge of the refractory member. During the pressing operation, this play of course must be first taken up. Thereafter, the stress applied to the metal ring will pass beyond the elastic range or elastic limit of the metal ring and result in permanent plastic elongation thereof. Additionally however, it is contemplated to be within the scope of the present invention that the metal ring could be provided in the form of a multilayer winding of a thin metal strip, for example a steel strip, without any play. In such arrangement, it would not be necessary to take up play during the initial portion of the pressing operation.

An essential feature of the present invention is that the portion of the metal ring being pressed into the indentation 7 is pressed by an amount until the innermost external surface of such portion is spaced a predetermined distance A from an external surface of the metal ring at a position at the peripheral edge of the refractory member 6 opposite the indentation 7. In other words, in the embodiment of FIG. 1, indentation 7 is centered at a longitudinal center axis of the elongated refractory member 6, and the pressing by stamping tool 26 is achieved along such axis. Opposite end 9 thus is pressed toward stop 22, and predetermined distance A is measured from the external surface of the metal ring at opposite position edge 9. By this arrangement, there are formed two locations of the assembly 10 which are a predetermined precise distance A from each other, and these precisely located positions can be employed for mounting the assembly in a removable but properly seated manner in a support frame of a sliding closure unit. The precise relative location of these two points of the assembly is achieved independently of external dimensional variations of the refractory member 6. Thus, upon formation of member 6, dimensional variations inevitably occur. However, in accordance with the present invention it is not necessary to further process or machine either the external surface of the member 6 or the external surface of the jacket 8.

It is contemplated to be within the scope of the present invention that the metal ring undergo a simple cold deformation with the metal ring being formed of a suitable quality steel to achieve a permanent plastic deformation, and indeed such arrangement is preferred. However, it is intended to be within the scope of the present invention to provide preheating of the metal ring should this be considered necessary or desirable.

Various possibilities exist for achieving the predetermined distance A, and two examples now will be described with reference to FIGS. 3 and 4.

Figure 3:
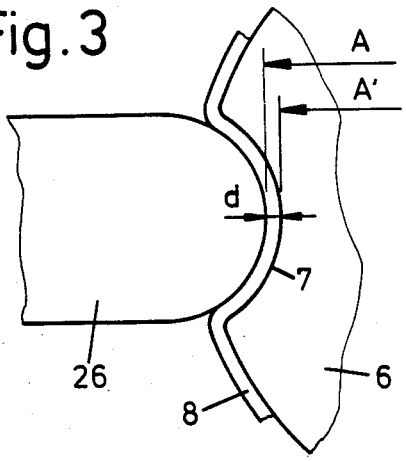
FIGS. 3 and 4 are partial schematic views illustrating different methods according to the present invention of achieving predetermined dimensional relationships.

Thus, in the embodiment of FIG. 3, at the end of the pressing operation the innermost portion of the metal ring extending into the indentation 7 will directly abut with the innermost surface of indentation 7. This arrangement also is shown schematically in the embodiment of FIG. 1. Accordingly, in this arrangement, it is the innermost surface of indentation 7 which is employed to achieve the predetermined distance A, and the stamping tool 26 simply presses the meral ring until it abuts with the indentation 7. In such arrangement, it is necessary that the innermost surface of indentation 7 be spaced from the opposite position 9 of the peripheral edge of the member 6 by a distance A' precisely equal to predetermined distance A minus twice the thickness d of the metal ring. This method has the advantage that the metal ring experiences only compressive stress during subsequent use in the sliding closure unit and that the application of force to the hard and relatively crack-prone refractory material of member 6 occurs over a large area, i.e. without dangerous concentrations of force.

Figure 4:
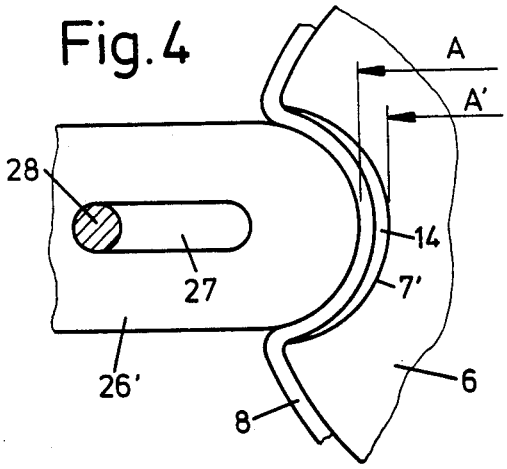

In contrast, in accordance with the embodiment of FIG. 4, the distance A' is determined to be less than the value of the predetermined distance A minus twice the thickness d of the metal ring. As a result, it is not necessary that indentation 7' be formed precisely to such value, but need be formed only roughly. Accordingly, the pressing operation is achieved in a manner to deform the portion of the metal ring into the indentation only to a predetermined extent to result in predetermined distance A. Thus, a gap 14 is provided between the surface of indentation 7' and the innermost surface of the metal ring. In the embodiment illustrated in FIG. 4, this is achieved by providing a predetermined limit to the inward movement of the stamping tool 26'. For example, this may be achieved by a stationary stop bolt 28 engaged in a groove 27 formed in stamping tool 26', whereby stop bolt 28 limits the extent of movement of tool 26'. In this arrangement, the sliding forces during subsequent use of the sliding closure unit are transferred indirectly via the metal jacket 8 to member 6, the metal jacket 8 being subjected to compressive and bending stresses. Since in this embodiment the distance A' need not be formed precisely, it is possible that the indentation 7' can be formed during the normal formation of the plate-shaped refractory member 6, i.e. before the baking thereof, and without the requirement for additional processing or machining of the surface of the indentation.

Figure 5:
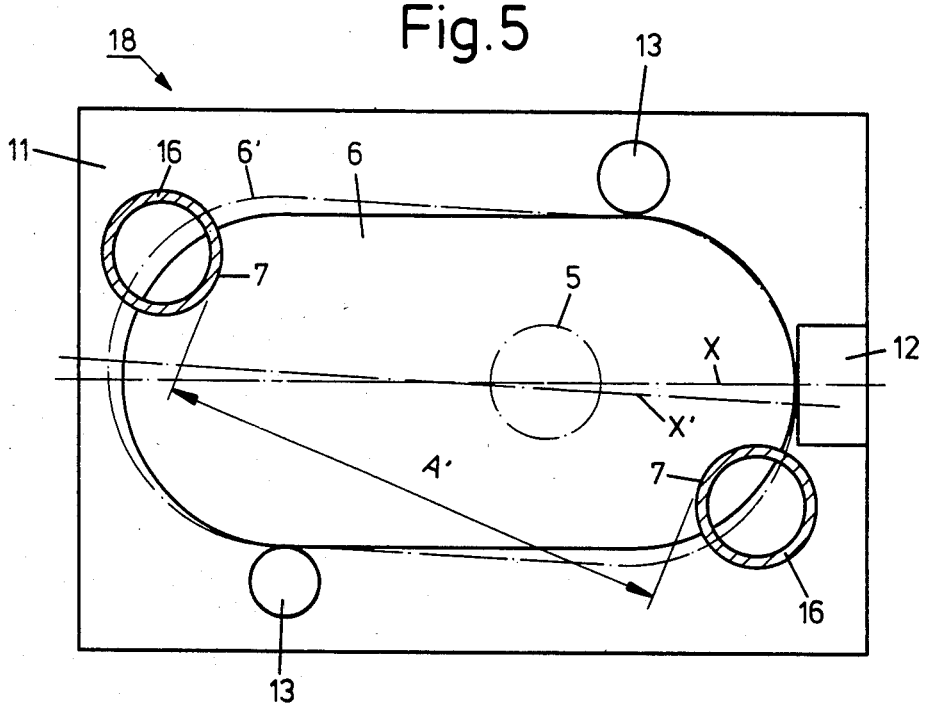
FIG. 5 is a schematic top view illustrating a method of forming or providing indentations in a refractory member according to another embodiment of the present invention.
Figure 6:
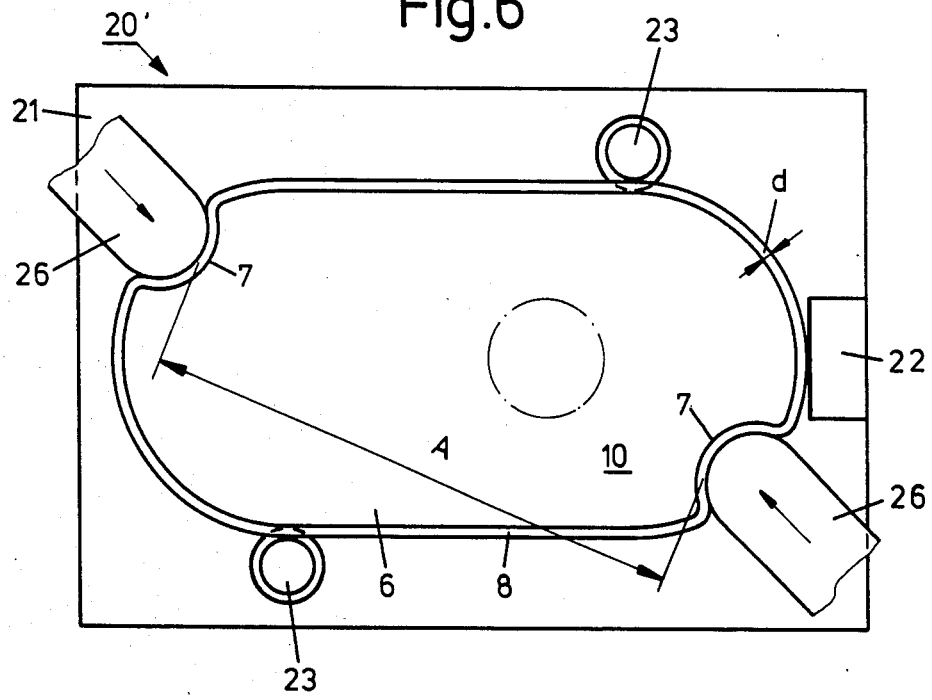
FIG. 6 is a view similar to FIG. 1 but illustrating a manner of constructing an assembly from the refractory plate formed in accordance with FIG. 5.
Figure 7:
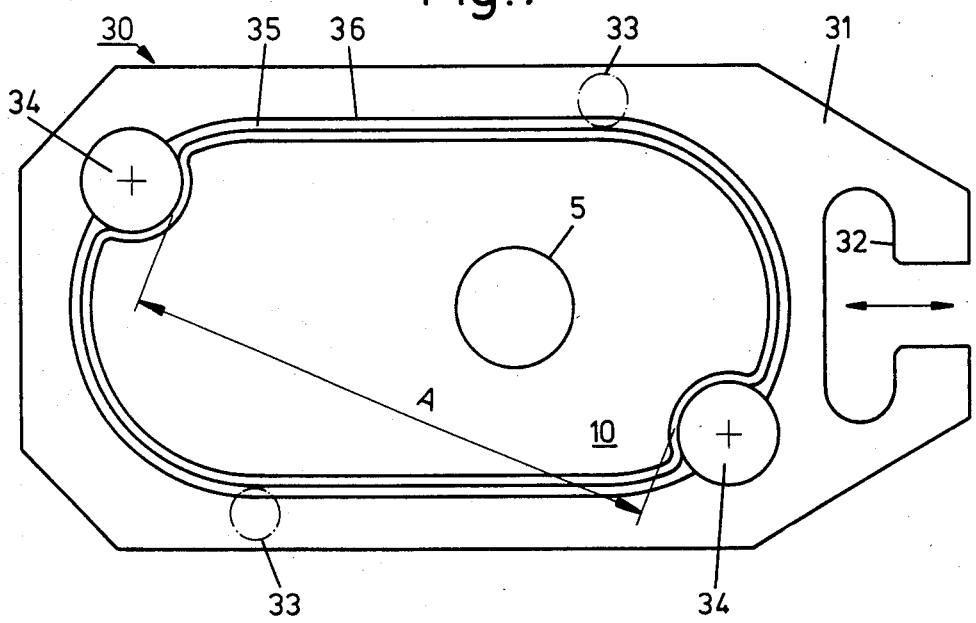
FIG. 7 is a schematic view illustrating the manner of mounting the assembly formed in FIG. 6 into a support frame of a sliding closure unit.

FIGS. 5 through 7 illustrate the manner of manufacture and construction of a refractory plate assembly according to another embodiment of the present invention. Again, the assembly 10 is oblong and is intended for use in a linear sliding closure unit. However, indentations 7 are formed in each of two end areas of the refractory member 6. Although it is intended to be within the scope of the present invention for indentations 7 to be formed along the longitudinal center axis of the member 6, to save space in use of the assembly in a sliding closure unit, indentations 7 preferably are formed in a symmetric pattern on opposite sides of such center axis X.

FIG. 5 shows a manner of precisely forming the two indentations 7 to be spaced by a distance A' which is equal to the predetermined distance A minus twice the thickness d of the metal ring. Thus, the refractory member 6 is positioned on a processing device 18 including a base plate 11 permanently mounting stops 12 and 13 at positions corresponding to the contour of member 6. Plate 6 is positioned on device 18 as a work piece and is held against stops 12, 13 by clamps (not shown). Two schematically indicated core bit drills 16 are movable in directions vertical to the plane of member 6 and are employed for forming indentations 7. The distance between the centers of the two drills 16 is determined so that the indentations 7 are formed precisely to the distance A'. Discharge opening 5 also could be drilled during this time.

It will be apparent from FIG. 5 that the drilling to form the indentations, as well as the further method of manufacture shown in FIG. 6 and the mounting of the resultant assembly in a support frame as shown in FIG. 7, are free of variations of the dimension of the circumference or periphery of the refractory member 6. Indeed, FIG. 5 illustrates by dashed lines a refractory member 6' having external dimensions larger than member 6. It will be apparent that such enlarged member 6' simply is positioned somewhat askew along a longitudinal axis X', and drills 16 simply form indentations 7 somewhat deeper into the peripheral edge of member 6'. The relative position of the two indentations to one another, and particularly the distance A' remain the same.

FIG. 6 illustrates the manner of connection of the metal jacket 8 to the periphery of the refractory member 6. Thus, a stamping device 20' includes a base plate 21 supporting a longitudinal stop 22 and a pair of guide bolts 23, in a manner somewhat similar to the embodiment of FIG. 1. However, bolts 23 are arranged in a somewhat different position with relation to the direction of advancement of two stamping tools 26. Stop devices 22, 23 are spaced further apart by a dimension equal to the thickness d of the metal ring with respect to the corresponding positions of stops 12, 13 of device 18 shown in FIG. 5. The pressing, deformation and elongation of the sheet metal ring is performed with respect to both indentations 7 by respective stamping tools 26 during the same operation. It is advantageous however if the stamping tool 26 most spaced from stop 22, i.e. the left tool 26 shown in FIG. 6, leads somewhat in the sequence to ensure secure contact against stops 22, 23.

As will be apparent from a consideration of FIG. 6, and as explained above regarding the formation of indentations 7 in FIG. 5, distance A' is precisely equal to the predetermined distance A minus twice the thickness d of the metal ring. In other words, tools 26 press respective portions of the metal ring against innermost surfaces of the indentations. However, it is contemplated that this embodiment of the present invention may incorporate the features illustrated in FIG. 4, i.e. wherein the tools 26 press inwardly predetermined lengths to define the predetermined distance A.

Assembly 10 leaves stamping device 20' ready for assembly with jacket sections along indentations 7 precisely corresponding to predetermined distance A. The remaining circumferential portions of the assembly however may have dimensions within a range of tolerance without effecting the positioning of the assembly in a support frame. It furthermore is contemplated to be within the scope of the present invention to provide additional indentations other than the two which are illustrated. For example, such additional indentations could be provided at positions corresponding approximately to the illustrated locations of stops 23.

FIG. 7 illustrates the manner of mounting the assembly 10 of FIG. 6 in a support frame of a sliding closure unit. Thus, the unit 30 includes a frame 31 attached in a known manner at 32 to a push rod to move the unit linearly in the directions shown by the double-headed arrow. The support frame 31 has therein a recess 36 for receiving assembly 10, there being provided a peripheral clearance 35 between the assembly and surrounding surface of recess 36, thereby accommodating dimensional variations of the assembly. Two connecting devices 34, for example in the form of circular discs, are mounted in frame 31 and fastened thereto, preferably in a releasable manner, with spacing between devices 34 corresponding to predetermined distance A. Devices 34 ensure exact positioning of the assembly 10 in relation to frame 31 exclusively by the edged indentations, and also transfer sliding forces which occur during use between the frame and the assembly. This arrangement enables the unit to be replaced rapidly and easily. Instead of such stationary, "passive" connecting devices, it also is possible to mount the assembly by means of tightening devices, for example in the form of eccentric discs. In such situation, stops 33 should be provided on frame 31 (clockwise tightening of the eccentrics being assumed) in order to receive tightening forces on the assembly in a transverse direction. It of course is contemplated that the attachment devices can fit into indented recesses formed on the central longitudinal axis of the assembly. However, as indicated above, the symmetrical offset location illustrated has the advantage of being able to provide frame 31 with a reduced longitudinal dimension.

Figure 8:
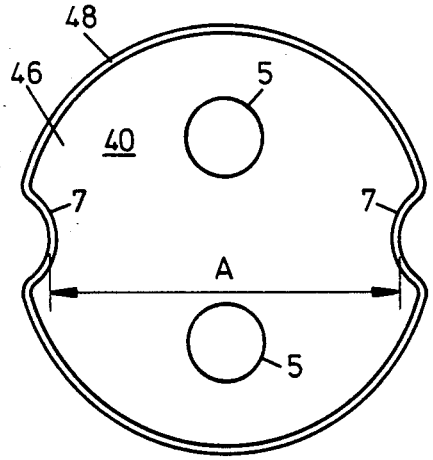
FIG. 8 is a schematic view of a refractory plate assembly manufactured according to the present invention and suitable for use in a rotary sliding closure unit.

FIG. 8 shows a refractory plate assembly 40 manufactured according to the present invention but particularly suitable for use in a rotary sliding closure unit. This assembly includes a refractory plate member 46 and a sheet metal jacket 48 drawn on to the peripheral edge thereof. Two diametrically opposite edge indentations 7 are provided in the member 46 and into which are pressed respective portions of the metal ring to define the predetermined distance A. The member 46 has therethrough two discharge openings 5 which are located at diametrically opposite positions, and it is advantageous if the two openings 5 and the two indentations 7 are located on respective diameters rotated 90° with respect to each other as shown.

Figure 9:
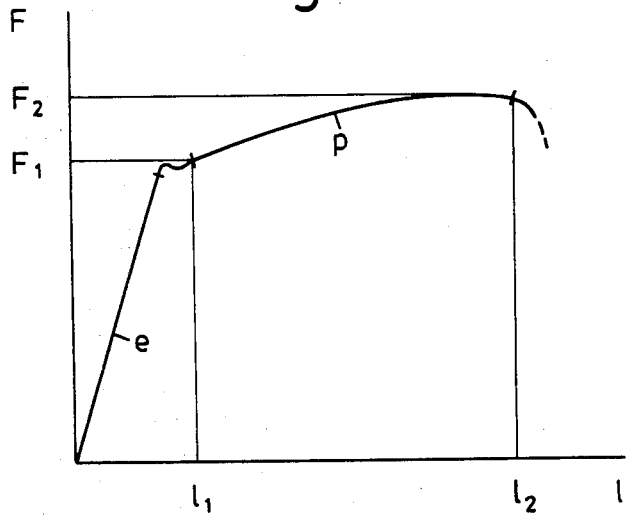
FIG. 9 is a typical stress-elongation diagram of a sheet metal ring made of a suitable material in accordance with the present invention and illustrating the stress range whereat permanent elongation of the metal ring occurs.

The stress-elongation diagram of FIG. 9 (tensile force or stress F as a function of ring length 1) illustrates features relative to the deformation and dimensioning of the metal ring. The material for the metal ring should be selected such that it exhibits a relatively wide and flat elongation range p between $\mathbf{1}_1$ and $\mathbf{1}_2$ subsequent and beyond the elastic limit or yield point, i.e. beyond the elastic range e. When the ring is pressed into the edge indentations, if applicable after elimination of play originally present between the ring and the peripheral edge of the plate member, elastic range e of the material of the ring is traversed firstly, whereupon elongation continues into the plastic elongation range p. The indentation depth or the increase in length achieved during the pressing operation should be selected in such a manner in relation to the initial length or circumference of the ring that plastic elongation range p and therewith a permanent elongation is achieved in each operation. Those skilled in the art readily would understand what metal materials and what relative dimensions thereof and dimensions of indentations should be provided to achieve this manner of permanent elongation. Stress or force F which exists thereby in the metal ring corresponds approximately (discounting friction) to the circumferential force with which the metal encompasses and presses against the refractory plate member. This circumferential force results for a given ring material from the size of the cross section of the ring. The width of the useful elongation range p between $\mathbf{1}_1$ and $\mathbf{1}_2$ allows a correspondingly large range of circumferential tolerances of the refractory plate member to be accommodated, while as a consequence of the relatively flat elongation range, the particularly corresponding circumferential force which is produced in the ring changes only slightly between $F_1$ and $F_2$.

The above embodiments of the present invention illustrate indentations 7, 7' formed in the shape of arcs of a circle. However, the present invention contemplates the provision of indentations of other configurations.

Figure 10:
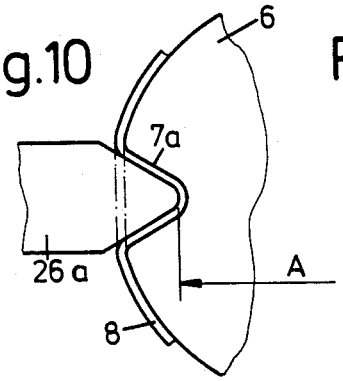
FIGS. 10 and 11 are views similar to FIGS. 3 and 4, but illustrating alternative indentation configurations.

Thus, FIG. 10 illustrates the provision of a V-shaped indentation *7a* by way of example into which the metal ring is pressed from its original position, indicated by dashed lines, by a stamping tool *26a*, to achieve the predetermined distance A.

Figure 11:
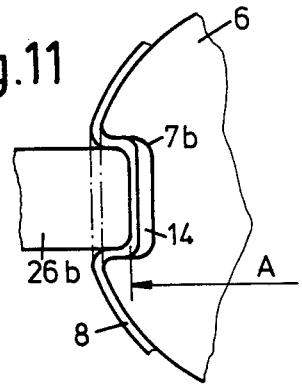

FIG. 11 illustrates another variation wherein there is provided a rectangular shaped indentation *7b* having rounded corners and a correspondingly shaped stamping tool *26b*. This configuration particularly is suitable for embodiments of the present invention wherein the indentations are not themselves employed as stops to limit the pressing operations, but rather wherein the respective portions of the metal ring are pressed only partially into the indentations, and wherein the extent of such pressing is limited by suitable stop devices, for example in the manner described above with regard to FIG. 4. Thus, a space or gap 14 is provided between the innermost surfaces of the indentations *7b* and the inwardly deformed portion of the metal ring.

Although the present invention has been described and illustrated with respect to preferred features thereof, it is to be understood that various modifications and changes as would be apparent to those skilled in the art may be made to the specifically described features without departing from the scope of the present invention.

I claim:

1. A method of manufacturing a prefabricated refractory closure plate assembly adapted to be readily inserted in a sliding closure unit, said assembly being of the type including a plate-shaped refractory member having therethrough at least one discharge opening and a metal jacket in tension surrounding and compressing the peripheral edge of said refractory member, said method comprising:

providing said refractory member with at least one indentation extending inwardly from said peripheral edge of said refractory member;

positioning a metal ring of a given width and thickness to surround said peripheral edge of said refractory member such that the entire width of a portion of said metal ring extends across said indentation;

pressing said portion of said metal ring across the entire width thereof into said indentation until an innermost external surface of said portion is spaced a predetermined distance from the external surface of said metal ring at a position at said peripheral edge of said refractory member opposite said indentation; and said pressing comprising permanently increasing the length of said metal ring by stressing said metal ring beyond the elastic limit thereof and thereby permanently deforming and tensioning said metal ring into intimate compression contact with said peripheral edge of said refractory member, thereby forming a prefabricated assembly of said refractory member and said metal ring permanently connected thereto which may be assembled within a supporting frame of a sliding closure unit.

2. A method as claimed in claim 1, comprising forming said indentation such that the innermost surface thereof is spaced from said opposite position of said peripheral edge by a distance having a maximum value equal to said predetermined distance minus twice the thickness of said metal ring.

3. A method as claimed in claim 2, wherein said distance equals said maximum value, and said pressing comprises moving said portion of said metal ring into abutment with said innermost surface of said indentation.

4. A method as claimed in claim 2, wherein said distance is less than said maximum value, and said pressing comprises moving said portion of said metal ring only partially into said indentation and thereby maintaining a space between said portion of said metal ring and said innermost surface of said indentation.

5. A method as claimed in claim 4, wherein said pressing comprises moving a stamping member against said portion of said metal ring and limiting such movement by a stop device to define said predetermined distance.

6. A method as claimed in claim 1, comprising positioning said external surface of said metal ring at said opposite position against a stop, and conducting said pressing in a direction generally toward said stop.

7. A method as claimed in claim 1, comprising providing said refractory member with a further indentation at said opposite position, and further presslng said metal ring into said further indentation.

8. A method as claimed in claim 7, comprising conducting both said pressing operations substantially simultaneously.

9. A method as claimed in claim 8, wherein said refractory member is circular, and comprising providing said indentations at diametrically opposite positions, and conducting said pressing operations in opposite directions toward each other.

10. A method as claimed in claim 8, wherein said refractory member is elongated for use in a linear sliding closure unit, and comprising providing said indentations at opposite end areas of said refractory member.

11. A method as claimed in claim 10, comprising providing said indentations at locations symmetrically on opposite sides of a longitudinal center axis of said refractory member.

12. A method as claimed in claim 1, comprising providing said indentation in the shape of an arc of a circle.

13. A method as claimed in claim 1, comprising providing said indentation to have a V-shape.

14. A method as claimed in claim 1, comprising providing said indentation to have a generally rectangular shape.

* * * * *